US009860649B2

(12) United States Patent
Berger et al.

(10) Patent No.: US 9,860,649 B2
(45) Date of Patent: Jan. 2, 2018

(54) INTEGRATED PACKAGE FORMING WIDE SENSE GAP MICRO ELECTRO-MECHANICAL SYSTEM MICROPHONE AND METHODOLOGIES FOR FABRICATING THE SAME

(71) Applicant: INVENSENSE, INC., San Jose, CA (US)

(72) Inventors: Renata Berger, Palo Alto, CA (US); Sushil Bharatan, Burlington, MA (US); Jeremy Parker, Chelmsford, MA (US); Aleksey S. Khenkin, Nashua, NH (US)

(73) Assignee: INVENSENSE, INC., San Jose, CA (US)

( * ) Notice: Subject to any disclaimer, the term of this patent is extended or adjusted under 35 U.S.C. 154(b) by 0 days.

(21) Appl. No.: 15/216,485

(22) Filed: Jul. 21, 2016

(65) Prior Publication Data

US 2016/0330550 A1 Nov. 10, 2016

Related U.S. Application Data

(62) Division of application No. 14/540,219, filed on Nov. 13, 2014, now Pat. No. 9,439,002.

(51) Int. Cl.
*H04R 25/00* (2006.01)
*H04R 19/04* (2006.01)
(Continued)

(52) U.S. Cl.
CPC ..... *H04R 19/04* (2013.01); *H04R 19/005* (2013.01); *H04R 23/00* (2013.01); *H04R 31/00* (2013.01); *H04R 2201/003* (2013.01)

(58) Field of Classification Search
CPC ..... H04R 19/04; H04R 19/05; H04R 23/00; H04R 31/00; H04R 2201/003
See application file for complete search history.

(56) References Cited

U.S. PATENT DOCUMENTS

2006/0093171 A1* 5/2006 Zhe ..... H04R 31/003 381/191
2007/0003082 A1 1/2007 Pedersen
(Continued)

OTHER PUBLICATIONS

Office Action dated Mar. 4, 2016 for U.S. Appl. No. 14/540,219, 11 pages.
(Continued)

*Primary Examiner* — Tuan D Nguyen
(74) *Attorney, Agent, or Firm* — Amin, Turocy & Watson, LLP

(57) ABSTRACT

A micro electro-mechanical system (MEMS) microphone is provided. The microphone includes: a package substrate having a port disposed through the package substrate, wherein the port is configured to receive acoustic waves; and a lid coupled to the substrate and forming a package. The MEMS microphone also includes a MEMS acoustic sensor disposed in the package and positioned such that the acoustic waves receivable at the port are incident on the MEMS acoustic sensor. The MEMS acoustic sensor includes: a back plate positioned over the port at a first location within the package; and a diaphragm positioned at a second location within the package, wherein a distance between the first location and the second location forms a defined sense gap, and wherein the MEMS microphone is designed to withstand a bias voltage between the diaphragm and the back plate greater than or equal to about 15 volts.

18 Claims, 6 Drawing Sheets

(51) Int. Cl.

| | |
|---|---|
| ***H04R 19/00*** | (2006.01) |
| ***H04R 23/00*** | (2006.01) |
| ***H04R 31/00*** | (2006.01) |

(56) References Cited

U.S. PATENT DOCUMENTS

| | | | | |
|---|---|---|---|---|
| 2009/0208037 | A1 | 8/2009 | Zhe | |
| 2010/0276766 | A1 | 11/2010 | Tang | |
| 2013/0177180 | A1 | 7/2013 | Bharatan et al. | |
| 2015/0304777 | A1* | 10/2015 | Xu ..... | H04R 1/326 381/58 |

OTHER PUBLICATIONS

International Search Report and Written Opinion for PCT Application No. PCT/US2015/059745 dated Mar. 22, 2016, 16 pages.

* cited by examiner

INTEGRATED PACKAGE FORMING WIDE SENSE GAP MICRO ELECTRO-MECHANICAL SYSTEM MICROPHONE AND METHODOLOGIES FOR FABRICATING THE SAME

CROSS REFERENCE TO RELATED APPLICATION

This application is a divisional of, and claims priority to, U.S. patent application Ser. No. 14/540,219, entitled "INTEGRATED PACKAGE FORMING WIDE SENSE GAP MICRO ELECTRO-MECHANICAL SYSTEM MICROPHONE AND METHODOLOGIES FOR FABRICATING THE SAME," filed on Nov. 13, 2014. The entirety of the above-referenced U.S. Patent Application is hereby incorporated herein by reference.

TECHNICAL FIELD

Embodiments of the subject disclosure relate generally to micro electro-mechanical system (MEMS) microphones, and particularly to wide sense gap MEMS microphones.

BACKGROUND

With current microphone technology, frequency response of the microphone is often problematic. The signal to noise ratio (SNR) of the microphone is defined by the noise integrated in the area under the frequency response curve, and therefore it is desirable that the resonant peak frequency is not in the range of audible frequencies of interest. MEMS microphones typically have a resonant peak frequency around 20 kilohertz (kHz) in an integrated package. However, it is desirable to push the resonant peak frequency out to a higher value.

Another problem associated with conventional MEMS microphones is that the sound pressure level at which final mechanical clipping occurs is not as high as would be desired. As such, the highest sound pressure level (SPL) that can be received by a diaphragm of a microphone and properly converted into an electrical signal without distortion is less than desired. Specifically, in conventional MEMS microphones, distortion will be experienced at a SPL of 135 decibels dB SPL, which means that 135 dB SPL is the final mechanical clipping point of the microphone. A MEMS microphone with a higher final mechanical clipping point (in terms of SPL value) would be desirable.

Yet another problem associated with conventional MEMS microphones is percent distortion for a defined SPL. For example, approximately 1% of distortion is obtained for sound pressure that reaches the 120 dB SPL mark. It is desirable to have a higher sound pressure level before such distortion is experienced. Increasing the final mechanical clipping point would also reduce the distortion levels at SPL levels that are below the final clipping point.

SUMMARY

In one embodiment, a MEMS microphone is provided. The MEMS microphone includes a package substrate having a port disposed through the package substrate, wherein the port is configured to receive acoustic waves; a lid mounted to the package substrate and forming a package. The MEMS microphone also includes an acoustic sensor disposed in the package and coupled to the package substrate, wherein the MEMS acoustic sensor is positioned such that the acoustic waves receivable at the port are incident on the MEMS acoustic sensor. The MEMS acoustic sensor includes: a back plate positioned over the port at a first location within the package; and a diaphragm positioned at a second location within the package, wherein a distance between the first location and the second location forms a defined sense gap, and wherein the MEMS microphone is designed to withstand a bias voltage between the diaphragm and the back plate greater than or equal to about 15 volts.

In another embodiment, another MEMS microphone is provided. The MEMS microphone has a resonant frequency between about 20 kilohertz and about 40 kilohertz and has a sensitivity factor within a range from about −38 dB volts per pascal to about −42 dB volts per pascal. In some embodiments, the MEMS microphone has sensitivity greater than or equal to about −38 dB volts per pascal. In various embodiments, the sensitivity of the MEMS microphone can be the number of volts of signal generated per one pascal of sound pressure, and therefore is the signal generated at a given sound pressure.

In yet another embodiment, another MEMS microphone is provided. This embodiment of the MEMS microphone includes: a package substrate having a port disposed through the package substrate, wherein the port is configured to receive acoustic waves; and a lid mounted to the package substrate and forming a package. The MEMS microphone also includes a MEMS acoustic sensor disposed in the package and coupled to the package substrate, wherein the MEMS acoustic sensor is positioned such that the acoustic waves receivable at the port are incident on the MEMS acoustic sensor. The MEMS acoustic sensor includes: a diaphragm; and a back plate, wherein a distance between the diaphragm and the back plate forms a defined sense gap, and wherein the diaphragm is configured to displace less than or equal to about 1/10 of a width of defined sense gap at a defined sound pressure level applied to the MEMS microphone. The distance between the diaphragm and the back plate forms a defined sense gap.

In yet another embodiment, another MEMS microphone is provided. This embodiment of the MEMS microphone includes a package substrate having a port disposed through the package substrate, wherein the port is configured to receive acoustic waves; and a lid mounted to the package substrate and forming a package. The MEMS microphone also includes a MEMS acoustic sensor disposed in the package and coupled to the package substrate, wherein the MEMS acoustic sensor is positioned such that the acoustic waves receivable at the port are incident on the MEMS acoustic sensor. The MEMS acoustic sensor includes: a variable capacitor formed by a combination of a back plate and a diaphragm having at least a portion that is substantially parallel to at least a portion of the back plate. The variable capacitor causes less than about one percent distortion error during conversion of a sound pressure signal to an electrical signal for a sound pressure signal having a level of or less than about 130 dB SPL.

In yet another embodiment, a method for making a MEMS microphone is provided. The method includes forming a package substrate having a port through the package substrate; and forming a capacitor on the package substrate, wherein the forming the capacitor includes: forming a back plate at a first location, wherein the back plate extends over the port; and forming a diaphragm at a second location. Forming the diaphragm includes: aligning the diaphragm over the port at the second location, wherein at least a portion of the back plate is aligned substantially parallel to the diaphragm, wherein a distance between the first location and the second location forms a defined sense gap, and wherein the MEMS microphone is designed to withstand a bias voltage between the diaphragm and the back plate greater than or equal to about 15 volts. The method can also include forming a lid from a first side of the package substrate to a second side of the package substrate, and around the back plate and the diaphragm.

A further understanding of the nature and the advantages of particular embodiments disclosed herein can be realized by reference of the remaining portions of the specification and the attached drawings.

DETAILED DESCRIPTION

A microphone is a device that converts sound pressure from acoustic waves received at a sensor to electrical signals. Microphones are used in numerous different applications including, but not limited to, hearing aids, voice recordation systems, speech recognition systems, audio recording and engineering, public and private amplification systems and the like.

MEMS microphones have numerous advantages including low power consumption and high performance. Additionally, MEMS microphones are available in small packages and facilitate use in a wide variety of applications that require a device with a small footprint. A MEMS microphone typically functions as a capacitive-sensing device, or acoustic sensor, that includes a pressure-sensitive diaphragm that vibrates in response to sound pressure resultant from an acoustic wave incident on the diaphragm. The acoustic sensors are often fabricated employing silicon wafers in highly-automated production processes that deposit layers of different materials on the silicon wafer and then employ etching processes to create the diaphragm and a back plate. The air moves through the back plate to the diaphragm, which deflects in response to the sound pressure associated with the air.

The sensed phenomenon is converted into an electrical signal. The electrical signal can be processed by an application specific integrated circuit (ASIC) for performing any number of functions of the MEMS microphone.

Embodiments described herein are MEMS microphones that include MEMS acoustic sensors that have wide sense gaps between the diaphragm and back plate of the acoustic sensors. The acoustic sensors act as capacitors and operate to facilitate sensing of the acoustic waves provided at the MEMS microphone. The embodiments advantageously have low distortion error relative to various sound pressure levels and are able to withstand high bias voltage.

Figure 1:
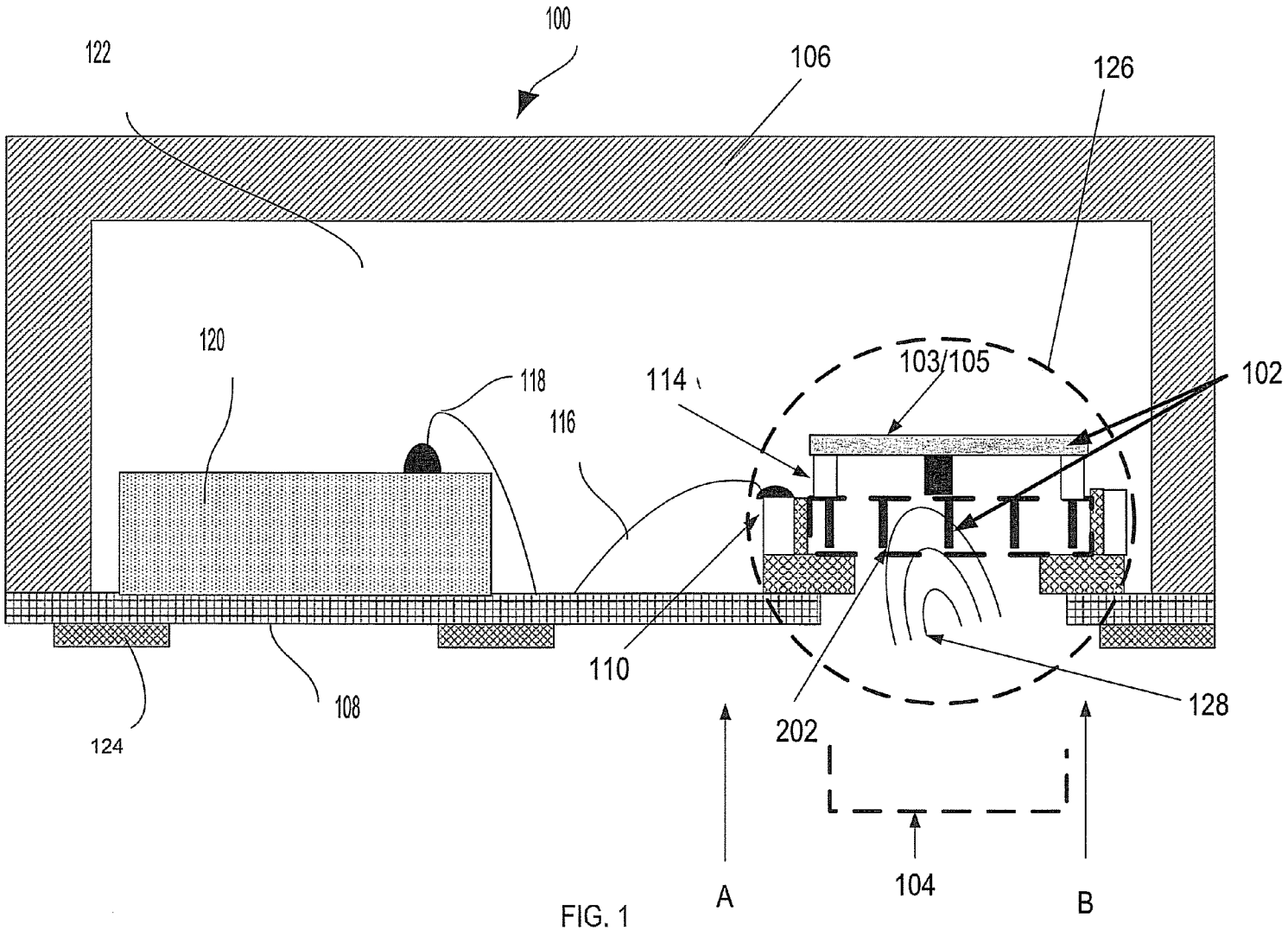
FIG. 1 illustrates an exemplary wide sense gap MEMS microphone integrated package in accordance with one or more embodiments described herein.
Figure 2:
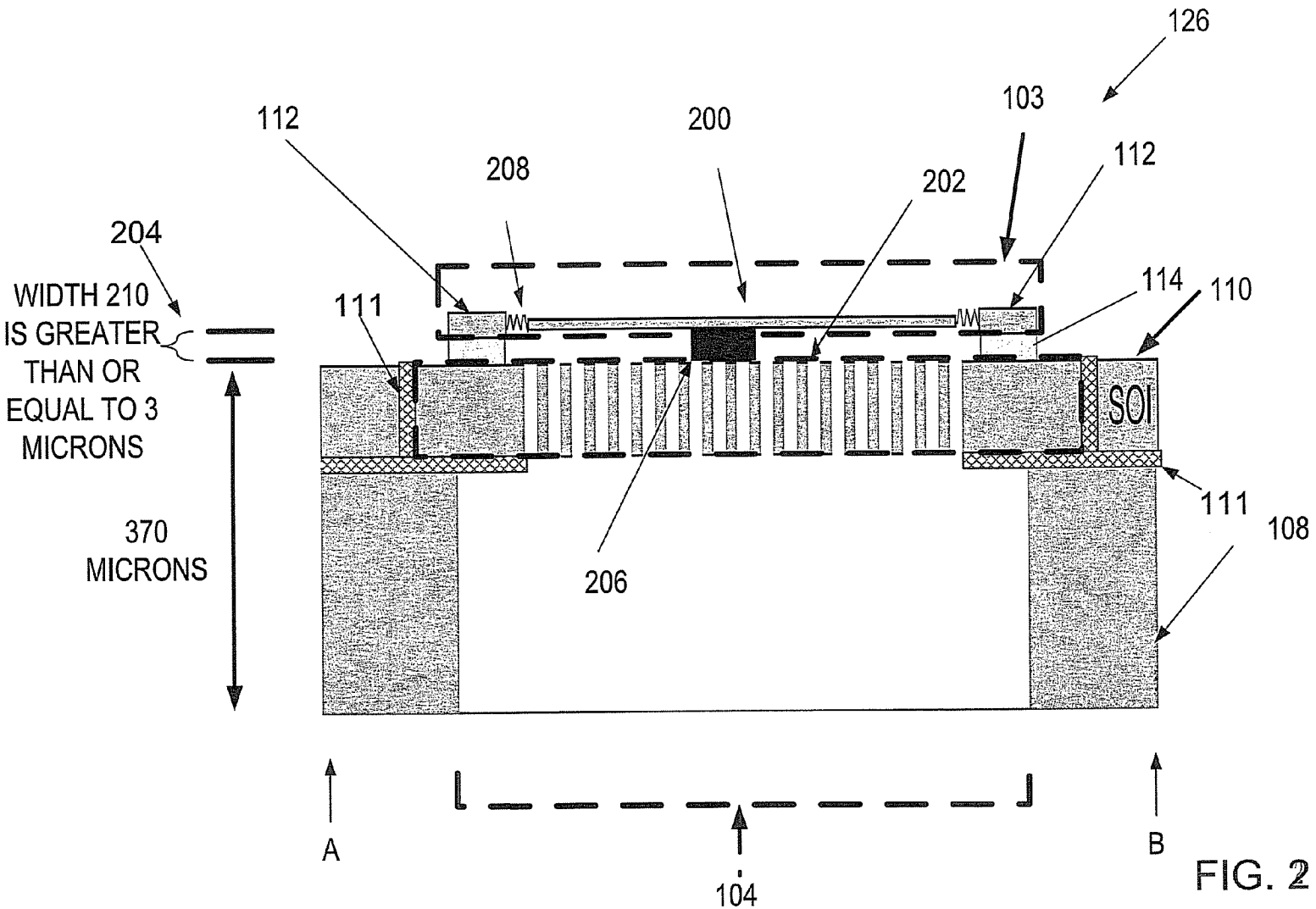
FIG. 2 illustrates an expanded view of a portion of the wide sense gap MEMS microphone of FIG. 1 including the wide sense gap MEMS acoustic sensor in accordance with one or more embodiments described herein.
Figure 3:
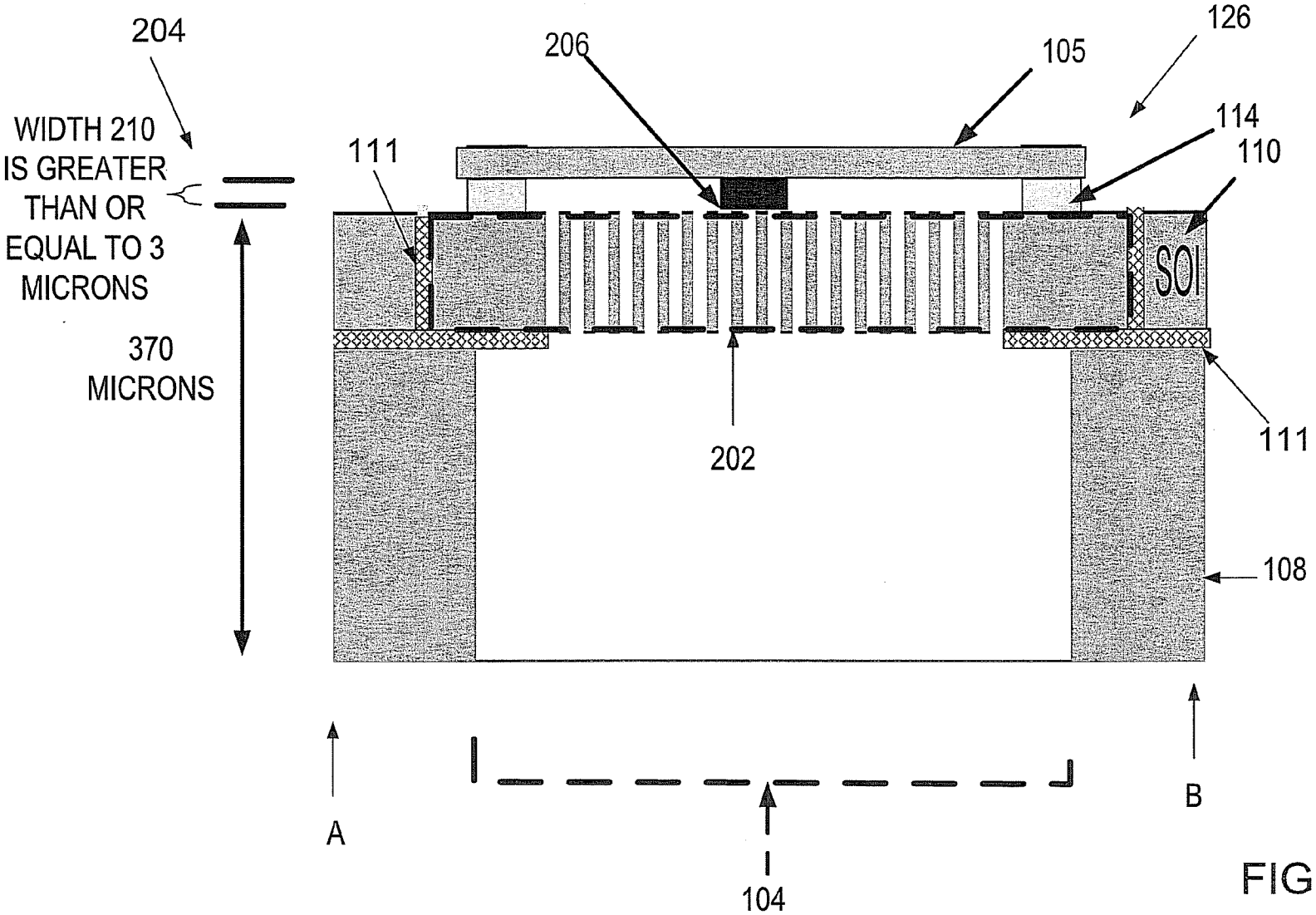
FIG. 3 illustrates an expanded view of a portion of the wide sense gap MEMS microphone of FIG. 1 including the wide sense gap MEMS acoustic sensor in accordance with another embodiment described herein.

Turning now to the drawings, FIG. 1 illustrates an exemplary wide sense gap MEMS microphone integrated package in accordance with one or more embodiments described herein. FIG. 2 illustrates an expanded view of a portion of the wide sense gap MEMS microphone of FIG. 1 including the wide sense gap MEMS acoustic sensor in accordance with one or more embodiments described herein. FIG. 3 illustrates an expanded view of a portion of the wide sense gap MEMS microphone of FIG. 1 including the wide sense gap MEMS acoustic sensor in accordance with another embodiment described herein. Repetitive description of like elements employed in respective embodiments of systems and/or apparatus described herein are omitted for sake of brevity.

Shown in FIG. 1 is an exemplary wide sense gap MEMS microphone integrated package 100 in accordance with one or more embodiments described herein. The MEMS microphone integrated package 100 of FIG. 1 includes a package substrate 108 (e.g., polymer (e.g., FR4) or ceramic substrate), a sensor substrate 110 (e.g., silicon substrate), a port 104 formed through package substrate 108, a lid (or cover) 106, and an acoustic sensor 102, which is a capacitor formed from the combination of diaphragm 103 and back plate 202 (or, as shown in FIG. 3, a capacitor formed from the combination of diaphragm 105 and back plate 202). As shown, wide sense gap MEMS microphone integrated package 100 can also include insulating layer 114, wire bonds 116, 118 and an ASIC 120. In various embodiments, one or more of the acoustic sensor 102, wire bonds 116, 118 and/or the ASIC 120 can be coupled to one another (e.g., electrically or otherwise) to perform one or more functions of the MEMS microphone integrated package 100.

In some embodiments, although not shown, acoustic sensor 102 as shown, described and/or claimed herein can be considered the combination of the diaphragm 103 (or, as shown in FIG. 3, diaphragm 105), the back plate 202 and the ASIC (including any connecting components between the diaphragm, the back plate and/or the ASIC, such as wire bonds 116, 118). All such embodiments are envisaged herein.

The diaphragm 103 (or, as shown in FIG. 3, diaphragm 105) can be a micro-machined structure that deflects or otherwise locates to a new position in response to acoustic wave 128. As described, in some embodiments, the acoustic sensor 102 can be or include a capacitor composed of the diaphragm 103 (or, as shown in FIG. 3, diaphragm 105) and the back plate 202. Insulating layer 114 can separate the diaphragm 103 (or, as shown in FIG. 3, diaphragm 105) from the back plate 202. For example, the insulating layer 114 can separate the diaphragm 103 (or, as shown in FIG. 3, diaphragm 105) from the sensor substrate 110 (from which the back plate 202 is formed) as shown.

In some embodiments, the back plate 202 and the sensor substrate 110 are part of the same layer. For example, the sensor substrate 110 can initially be one solid substrate from end A to end B and insulation material 111 can then be embedded in sensor substrate 110 to define the ends of back plate 202. As shown in FIGS. 2 and 3, in some embodiments, back plate 202 can include a perforated region and a solid, non-perforated region. Specifically, the substantially vertical lines in the back plate 202 can represent perforations in the back plate 202 that are provided to allow acoustic sound waves 128 to pass through the back plate 202 to the diaphragm 103 (or, as shown in FIG. 3, diaphragm 105). In some embodiments, sensor substrate 110 and back plate 202 are formed from a silicon on insulator (SOI) layer.

As described, the acoustic sensor 102 can be composed of the diaphragm (e.g., diaphragm 103 or diaphragm 105 in FIGS. 1, 2 and/or 3) and the back plate 202 with sense gap 204 (shown in FIGS. 2 and 3) between the diaphragm 103 (or diaphragm 105) and the back plate 202. One or more portions of diaphragm 103 (or diaphragm 105) can deflect in response to acoustic waves (e.g., acoustic wave 128) incident on the diaphragm 103 (or diaphragm 105). As such, the diaphragm 103 (or diaphragm 105) and the back plate 202 can form a capacitor having a capacitance that varies as the distance (e.g., width of the sense gap 204) between the diaphragm 103 (or diaphragm 105) and the back plate 202 varies. The acoustic wave 128 enters the integrated package 100 through the port 104 formed through the wafer 108.

The port 104 can be any size suitable for receiving and/or detecting the acoustic waves 128 intended to enter the MEMS microphone integrated package 100. Specifically, the port 104 can provide a recess/opening to an external environment outside of the MEMS microphone integrated package 100 such that sound generated external to the MEMS microphone integrated package 100 is received by the port 104. Accordingly, the port 104 can be positioned at any number of different locations within package substrate 108 in suitable proximity to the back plate 202 and diaphragm 103 (or diaphragm 105) that allows the diaphragm 103 (or diaphragm 105) to detect the sound waves corresponding to the sound generated external to the MEMS microphone integrated package 100.

As described, acoustic waves 128 enter the MEMS microphone integrated package 100 via the port 104 provided through the package substrate 108, pass through the perforated region of the back plate 202 and are incident on the diaphragm 103 (or diaphragm 105). The diaphragm 103 (or diaphragm 105) deflects as a result of the sound pressure associated with the acoustic waves 128, and a capacitance results between the diaphragm 103 (or diaphragm 105) and the back plate 202 based on the deflection. The ASIC 120 measures the variation in voltage that results when the capacitance changes.

In some embodiments, the ASIC 120 can further process the information at the ASIC for any number of different functions. For example, the variation in capacitance can be amplified to produce an output signal. In various embodiments, the ASIC 120 can include circuitry/components for performing any number of different functions.

A portion 126 of the MEMS microphone integrated package 100 will be described in further detail with reference to FIGS. 2 and 3. Repetitive description of like elements employed in respective embodiments of systems and/or apparatus described herein are omitted for sake of brevity. As shown, in one embodiment, diaphragm 103 can include diaphragm center portion 200 and diaphragm layer 112 coupled to one another via one or more springs 208 to facilitate flexible deflection of the diaphragm center portion 200.

In one embodiment, the diaphragm layer 112 and the diaphragm center portion 200 are formed initially from a single, continuous solid substrate. The diaphragm center portion 200 is removed and one or more of springs 208 are embedded between the diaphragm center portion 200 and the diaphragm layer 112 coupling the diaphragm center portion 200 and the diaphragm layer 112 to one another while suspending the diaphragm center portion 200 above the back plate 202. In this embodiment, the diaphragm 103 is formed of the diaphragm center portion 200, diaphragm layer 112 (on each side of diaphragm center portion 200) and one or more springs 208. The springs 208 can be a 24-spring suspension device in some embodiments.

While the one or more springs 208 are employed in FIG. 2, in other embodiments, springs 208 need not be provided in the embodiment to suspend the diaphragm over the back plate 202. As shown in FIG. 3, for example, in one embodiment, the diaphragm 105 is a single, continuous layer without intervening springs or other components. In either embodiment of diaphragm 103 or diaphragm 105, the diaphragm 103 or diaphragm 105 can deflect in response to acoustic waves 128 incident on the diaphragm 103 or diaphragm 105 and the capacitance between the back plate 202 and the diaphragm 103 or diaphragm 105 can change as a result of the deflection.

In either embodiment shown in FIG. 2 or FIG. 3, the diaphragm 103 (or diaphragm 105) can be positioned substantially parallel to the back plate 202 when the diaphragm 103 (or diaphragm 105) is at rest (e.g., not experiencing deflection). In some embodiments, at least a portion of the diaphragm 103 (or diaphragm 105) and the back plate 202 are positioned substantially parallel to one another when the diaphragm 103 (or diaphragm 105) is at rest. In various embodiments, the diaphragm 103 (or diaphragm 105) can be composed of polysilicon or a combination of silicon nitride, polysilicon and/or metal (e.g., aluminum). In some embodiments, the diameter of the diaphragm 103 (or diaphragm 105) is 0.5 millimeters (mm) to 1.5 mm. In some embodiments, the diameter of the diaphragm 103 (or diaphragm 105) is greater than 1.5 mm. The back plate 202 can be composed of single crystal silicon or a combination of silicon nitride, single crystal silicon and/or metal (e.g., aluminum). The holes in the back plate 202 can be 5 to 15 microns in diameter but can be different shapes in different embodiments with 2 to 10 microns spacing between the holes.

The back plate 202 can be a layer of material (including a perforated portion and, in some embodiments, also including a solid, continuous portion) used as an electrode to electrically sense the diaphragm 103 (or diaphragm 105). In the described embodiments, the perforations can be acoustic openings for reducing air damping in moving portions of the back plate 200.

The width 210, or distance, between the at rest position of the diaphragm 103 (or diaphragm 105) and the back plate 202 can be the sense gap 204. In some embodiments, the sense gap 204 can be a wide sense gap that has a width 210 of approximately six microns in some embodiments. In other embodiments, the width 210 of the sense gap 204 can be between three microns and six microns. As such, notwithstanding conventional wisdom is to decrease the size of components in order to facilitate MEMS devices, in the embodiments described herein, the sense gap 204 is wide relative to conventional sense gaps, and therefore the design is contrary to the conventional trend in reducing the size of components, gaps and overall MEMS structures. The wide sense gap 204 advantageously enables a higher voltage to be applied to the MEMS microphone than conventional systems that do not include the wide sense gap 204.

A center post 206 is a substantially hard contact joining the diaphragm 103 (or diaphragm 105) and the back plate 202 that is formed and positioned such that when the sound pressure is incident on the back plate 202 and the diaphragm 103 (or diaphragm 105), only the diaphragm center portion 200 (or diaphragm 105) (or, in some embodiments, primarily the diaphragm center portion 200 (or diaphragm 105)) deflects.

The bias voltage between the diaphragm 103 (or diaphragm 105) and the back plate 202 is substantially higher than conventional bias voltages and can be approximately 36 volts in some embodiments. Significantly, the bias voltage is approximately three times the amount of the bias voltage in traditional systems. The wide width 210 of the sense gap 204 facilitates the high bias voltage. The extremely high bias voltage for which this combination acoustic sensor 102 is designed enables the MEMS microphone integrated package of FIG. 1 to achieve high performance.

As such, in some embodiments, the acoustic sensor 102 includes a relatively large sense gap 204 with a high voltage ASIC (e.g., ASIC 120 of FIG. 1). In some embodiments, the ASIC can operate at voltages greater than 30 volts.

In some embodiments, an acoustic wave 128 travels through the perforations of the back plate 202 to the diaphragm 103 (or diaphragm 105). The diaphragm center portion 200 (or diaphragm 105) moves up and down and/or deflects in response to the sound pressure associated with the acoustic wave 128.

The resonant frequency of the MEMS microphone can differ from the resonant frequency of the diaphragm 103 (or diaphragm 105) and is typically a few kilohertz (kHz) less than the resonant frequency of the diaphragm 103 (or diaphragm 105). As an example, the diaphragm 103 (or diaphragm 105) can resonate at a frequency that is greater than or equal to about 32 kHz (as measured in a vacuum). By contrast, the MEMS microphone built with the acoustic sensor 102 can resonate at about 20 kHz to about 40 kHz, depending on the various aspects of the MEMS microphone integrated package (e.g., MEMS microphone integrated package 100 of FIG. 1). In some embodiments, the MEMS microphone can have a resonant peak of 45 kHz standing alone and 30 kHz when in an integrated package.

In one embodiment, the material from which the diaphragm center portion 200 (or diaphragm 105) is formed can be a substantially stiff material resulting in a flatter frequency response due to an increased resonant frequency. In embodiments in which the diaphragm is composed of silicon nitride, higher resonant frequencies and flatter frequency response can result. As used herein, the term "flatter frequency response" implies the resonant frequency, which occurs at frequency greater than 20 kHz. Flatness of frequency response can be important in the audio band of 20 Hz to 20 kHz and is measured relative to 1 kHz value. As such, over this range (e.g., 20 Hz to 20 kHz), sensitivity is ±3 dB of the value of 1 kHz. Diaphragms composed of polymer materials can result in a less flat frequency response. Diaphragms that are thinner can result in a less flat frequency response than the frequency response of thicker diaphragms.

In some embodiments, to limit distortion, it is useful to limit the amount of deflection of the diaphragm center portion 200 (or diaphragm 105) as a function of the applied sound pressure level at the diaphragm center portion 200. For example, in one embodiment, for acoustic waves at a sound pressure level of 130 dB, the acoustic sensor 102 is designed such that the diaphragm center portion 200 (or diaphragm 105) deflects less than 1/10 the width 210 of the sense gap 204. As used herein, the value of 1/10 is a rule of thumb and in other embodiments, higher values (e.g., 1/8 the width 210 or 1/5 the width 210) can be acceptable. The wide sense gap 204 is employed to enable increased a flatter frequency response, withstanding of increased bias voltage and reduced distortion value.

Currently, microphones have about one percent distortion at 120 dB SPL. However, it is desirable to push out the sound pressure level (SPL) at which the one percent distortion is experienced. One or more embodiments described herein can achieve a sound pressure level of 130 dB SPL at one percent distortion. The embodiments described herein, which employ a wide gap acoustic sensor and high bias for a MEMS microphone can accomplish the goals described herein. For example, when the sense gap of the acoustic sensor is increased, higher sound pressure level must be experienced (and 130 dB SPL might be achieved) before the diaphragm center portion 200 (or diaphragm 105) contacts the back plate 202. When the wide sense gap 204 is increased, the diaphragm center portion 200 (or diaphragm 105) can be made to be stiffer and correspondingly increase the bias voltage between the diaphragm center portion 200 (or diaphragm 105) and the back plate 202.

In various embodiments, the variable capacitor formed by the particular diaphragm 103 (or diaphragm 105) and back plate 202 along with the wide sense gap 204 causes less than about one percent distortion error during conversion of a sound pressure signal to an electrical signal for a sound pressure signal having a level of or less than about 130 dB SPL.

In yet another embodiment, the sense gap 204 can be increased and the diaphragm center portion 200 (or diaphragm 105) can be made stiffer to require an increase in the bias voltage between the diaphragm 103 (or diaphragm 105) and the back plate 202. The higher bias would allow the acoustic sensor 102 to retain the sensitivity that would otherwise be lost because of the stiffer diaphragm center portion 200 and the increased sense gap 204. As the width of the sense gap 204 increases, sensitivity tends to drop at the ratio of 1/(width of the sense gap 204).

In one or more embodiments, the bias voltage is increased by $1/(\text{width of the sense gap})^{1.5}$ to more than adequately compensate for the increased sense gap 204 and the resultant loss of sensitivity. As such, the acoustic sensor 102 can also have a sensitivity factor within a range from about −38 dB volts per pascal to about −42 dB volts per pascal. In some embodiments, the range can be adjusted by +/−3 dB volts per pascal.

Turning back to FIG. 1, in one embodiment, the lid 106 is composed of metal. In an embodiment of the subject disclosure, the package substrate 108 is composed of a polymer. For example, the package substrate 108 can be composed of ceramic material.

As shown, a back cavity 122 is formed in an area in which no components of the MEMS microphone integrated package 100 are located upon mounting the lid 106 to the package substrate 108. In some embodiments, the back cavity 122 can be a partial enclosed cavity equalized to ambient pressure via Pressure Equalization Channels (PEC). In various aspects of the embodiments described herein, the back cavity 122 can provide an acoustic sealing for waves entering the integrated package 100.

Solder 124 connects the MEMS microphone integrated package 100 to an external substrate. The solder 124 can be utilized to join/couple the MEMS microphone integrated package 100 to different systems. As such, the embodiments of the MEMS microphone integrated package 100 described herein can be employed in any number of different systems including, but not limited to, mobile telephones, smart watches and/or wearable exercise devices.

While the components are shown in the particular arrangement illustrated in FIG. 1, in other embodiments, any number of different arrangements of the components is possible and envisaged. For example, any number of arrangements that place the port 104 is proximity to the acoustic sensor 102 such that sound waves can be detected at the acoustic sensor 102 can be employed. As another example, any configuration of the ASIC 120, the acoustic sensor 102 and the wire bonds 116, 118 that electrically coupled the ASIC 120 and the acoustic sensor 102 can be employed.

As described, the MEMS microphone integrated package 100 to different systems can be coupled to and/or employed within any number of different types of systems that utilize microphone technology. As such, the embodiments of the MEMS microphone integrated package 100 described herein can be employed in different systems including, but not limited to, mobile telephones, smart watches and/or wearable exercise devices. In one example embodiment, for instance, a system including the MEMS microphone integrated package 100 can be a smart watch designed to perform one or more functions (e.g., display time, date, navigation information, update time and data information) as a result of a audio command (and corresponding acoustic sound waves) received at the system and processed by the MEMS microphone integrated package 100 within the system. Although particular types of systems in which the MEMS microphone integrated package 100 can be employed have been referenced, the description has provided only examples and thus the description is not limited to these particular embodiments. Other systems that employ the functionality that can be provided by the MEMS microphone integrated package 100 can also include the MEMS microphone integrated package 100 and are envisaged herein.

Figure 4:
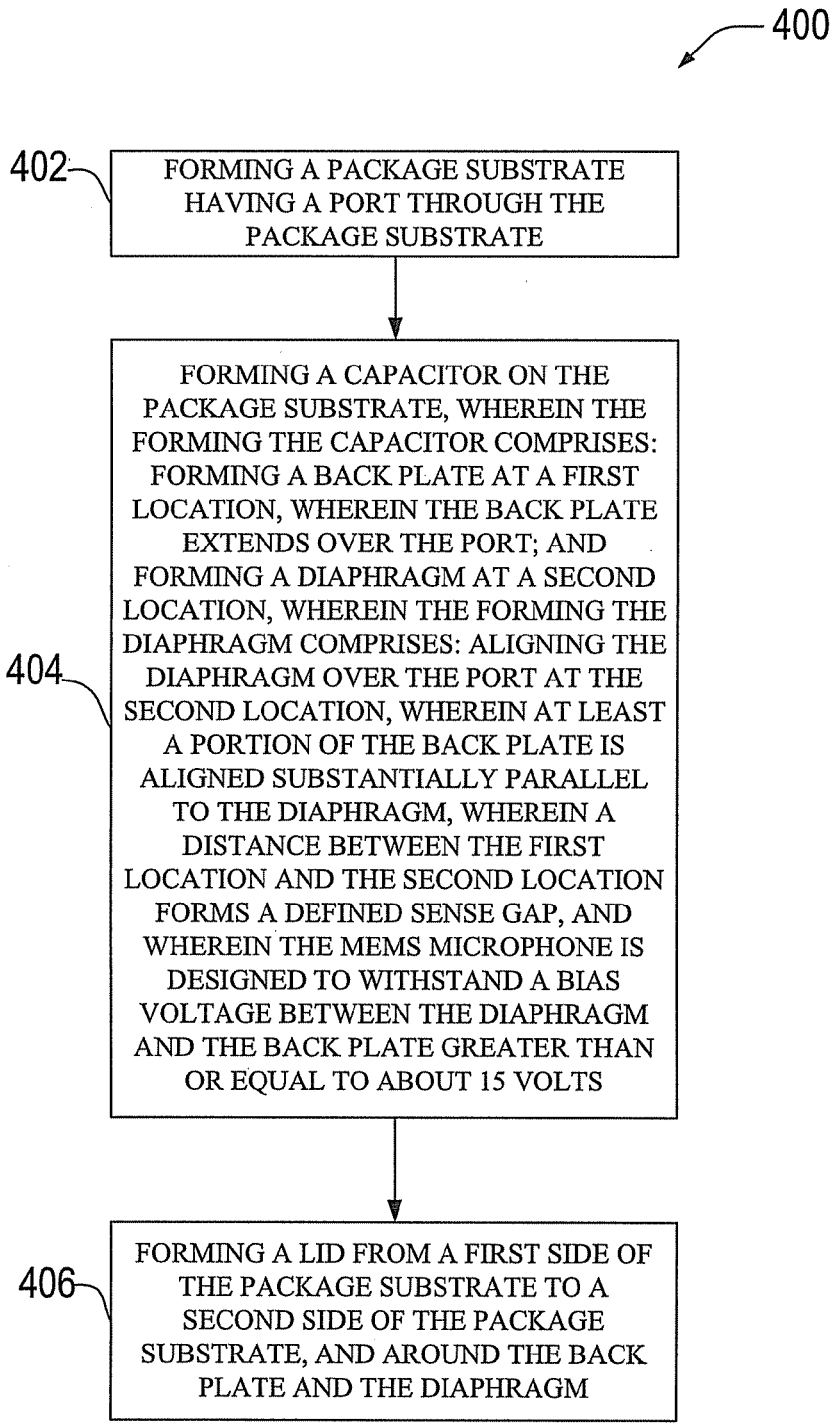
FIGS. 4, 5 and 6 illustrate exemplary methods of fabrication of the wide sense gap MEMS microphone integrated package of FIG. 1 in accordance with one or more embodiments described herein.
Figure 5:
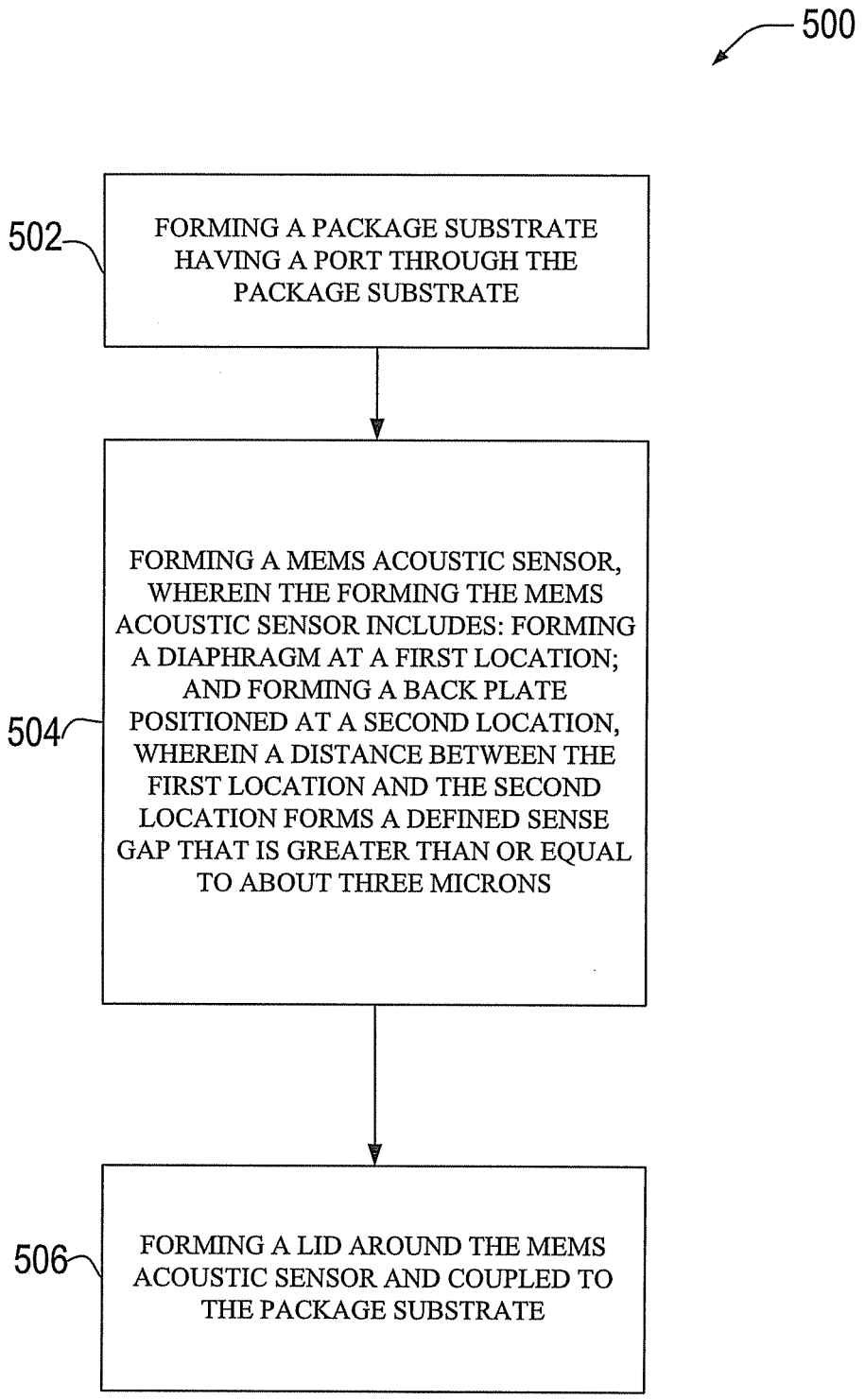
Figure 6:
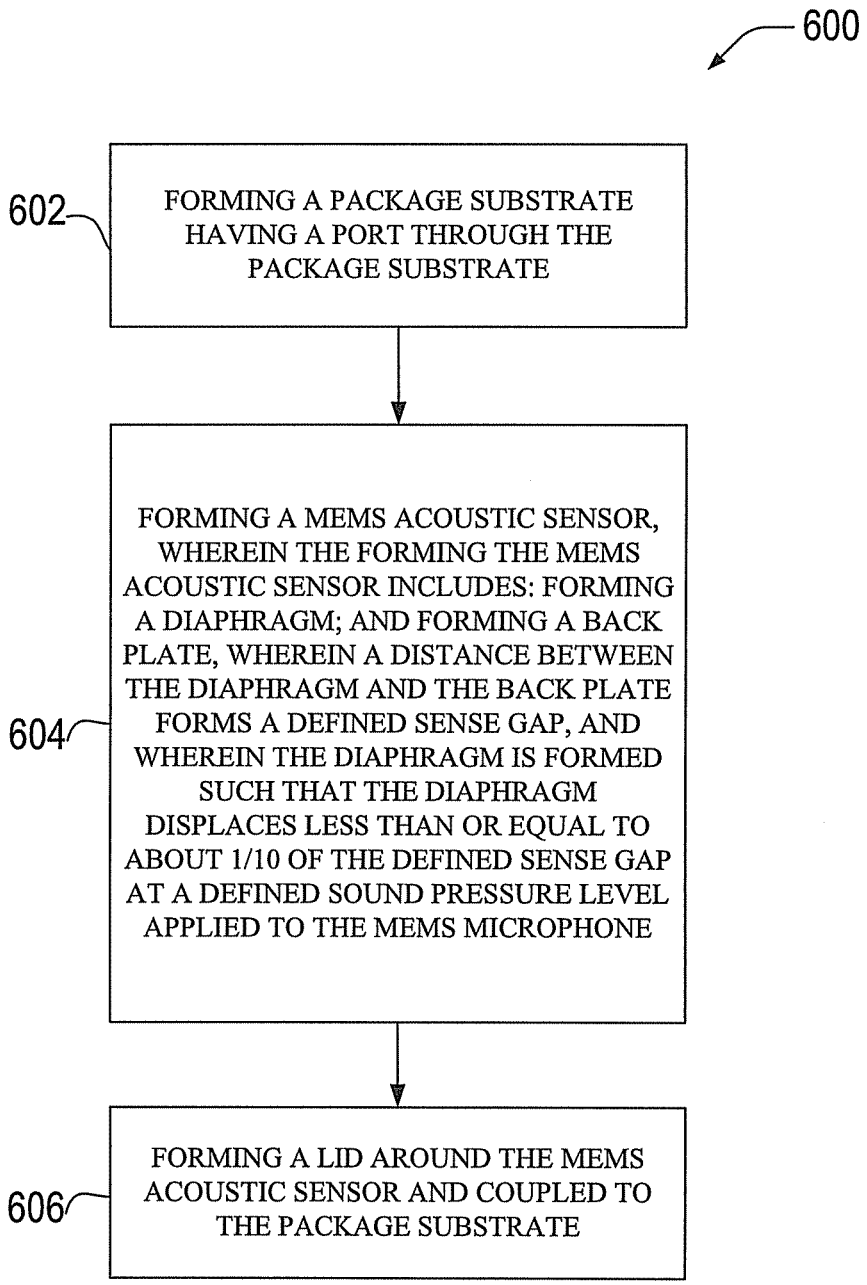

FIGS. 4, 5 and 6 illustrate exemplary methods of fabrication of the wide sense gap MEMS microphone integrated package of FIG. 1 in accordance with one or more embodiments described herein. Turning first to FIG. 4, at 402, method 400 can include forming a wafer having a port through the wafer. The port can be configured to receive acoustic waves from a source external to the MEMS microphone integrated package.

At 404, method 400 can include forming a capacitor on the wafer, wherein the forming the capacitor includes: forming a back plate at a first location, wherein the back plate extends over the port; and forming a diaphragm at a second location. The forming the diaphragm includes: aligning the diaphragm over the port at the second location, wherein at least a portion of the back plate is aligned substantially parallel to the diaphragm. The distance between the first location and the second location forms a defined sense gap, and the MEMS microphone is designed to withstand a bias voltage between the diaphragm and the back plate greater than or equal to about 15 volts. In some embodiments, non-MEMS microphones could withstand a bias voltage of about 200 volts.

At 406, method 400 can include forming a lid from a first side of the wafer to a second side of the wafer, and around the back plate and the diaphragm. In some embodiments, the lid can be hermetically sealed to the wafer in some embodiments to provide an airtight seal protecting the components of the integrated package.

The ASIC (e.g., ASIC 120 of FIG. 1) and the MEMS microphone withstand high voltages, and the high voltage can be generated in the ASIC. In some embodiments, the MEMS microphone integrated package (e.g., MEMS microphone integrated package 100 of FIG. 1) does not experience a high bias voltage; rather, the MEMS microphone integrated package typically receives a supply voltage of about 3.3 volts.

Turning now to FIG. 5, at 502, method 500 can include forming a wafer having a port through the wafer. The port can be configured to receive acoustic waves from a source external to the MEMS microphone integrated package.

At 504, method 500 can include forming a MEMS acoustic sensor, wherein the forming the MEMS acoustic sensor includes: forming a diaphragm at a first location; and forming a back plate positioned at a second location, wherein a distance between the first location and the second location forms a defined sense gap that is greater than or equal to about three microns. In some embodiments, the defined sense gap can be any width between three microns and six microns.

At 506, method 500 can include forming a lid around the MEMS acoustic sensor and coupled to the wafer. In some embodiments, the lid can be hermetically sealed to the wafer in some embodiments to provide an airtight seal protecting the components of the integrated package.

Turning now to FIG. 6, at 602, method 600 can include forming a wafer having a port through the wafer. At 604, method 600 can include forming a MEMS acoustic sensor, wherein the forming the MEMS acoustic sensor includes: forming a diaphragm; and forming a back plate. The distance between the diaphragm and the back plate forms a defined sense gap, and the diaphragm is configured to displace less than or equal to about 1/10 of a width of defined sense gap at a defined sound pressure level applied to the MEMS microphone.

In some embodiments, the displacement of the diaphragm indicates a deflection of a portion of the diaphragm. The defined sense gap can have a width indicated by reference numeral 210 of FIG. 2. Accordingly, in this method the diaphragm is formed such that the diaphragm deflects less than or equal to about 1/10 of the width 210 of defined sense gap. Material selection, thickness and/or stiffness of the springs, if springs are used, can result in the diaphragm experiencing deflection less than or equal to 1/10 of the width of the defined sense gap at a sound pressure level of greater than or equal to 130 dB. For example, the stiffer a material, or the thicker the material or the shorter the springs, the less deflection of the diaphragm.

At 606, method 600 can include forming a lid around the MEMS acoustic sensor and coupled to the wafer. In some embodiments, the lid can be hermetically sealed to the wafer in some embodiments to provide an airtight seal protecting the components of the integrated package.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

Thus, while particular embodiments have been described herein, latitudes of modification, various changes, and substitutions are intended in the foregoing disclosures, and it will be appreciated that in some instances some features of particular embodiments will be employed without a corresponding use of other features without departing from the scope and spirit as set forth. Therefore, many modifications can be made to adapt a particular situation or material to the essential scope and spirit.

What is claimed is:

1. A micro electro-mechanical system (MEMS) microphone having a resonant frequency limited to between 20 kilohertz and 40 kilohertz and having a sensitivity factor limited to between −38 decibel (dB) volts per pascal and −42 dB volts per pascal, wherein the MEMS microphone is comprised of a package having a port for receiving acoustic waves and comprising:

a MEMS acoustic sensor comprising a diaphragm and a back plate substantially parallel to the diaphragm and positioned such that the acoustic waves are incident on the back plate and the diaphragm, wherein the MEMS microphone is configured to withstand a bias voltage between the diaphragm and the back plate of greater than or equal to 25 volts.

2. The MEMS microphone of claim 1, wherein the MEMS microphone comprises:

a package substrate having a port disposed through the package substrate, wherein the port is configured to receive acoustic waves; and a lid mounted to the package substrate and forming a package.

3. The MEMS microphone of claim 2, wherein the MEMS microphone further comprises:

a MEMS acoustic sensor disposed in the package and coupled to the package substrate, wherein the MEMS acoustic sensor is positioned such that the acoustic waves receivable at the port are incident on the MEMS acoustic sensor.

4. The MEMS microphone of claim 3, wherein the MEMS acoustic sensor comprises:

a diaphragm positioned at a first location; and a back plate positioned at a second location, wherein a distance between the first location and the second location forms a defined sense gap that is greater than or equal to three microns.

5. The MEMS microphone of claim 3, further comprising:

an application specific integrated circuit (ASIC) disposed within the package and configured to process information generated by the MEMS acoustic sensor.

6. The MEMS microphone of claim 1, wherein the package further comprises:

an application specific integrated circuit (ASIC) electrically coupled to the MEMS acoustic sensor, wherein the ASIC is configured to process a datum generated by the MEMS acoustic sensor.

7. The MEMS microphone of claim 1, wherein the MEMS microphone is comprised of a package having a port for receiving acoustic waves and comprising:

a MEMS acoustic sensor comprising:

a back plate and a diaphragm wherein at least a portion of the diaphragm is substantially parallel to the back plate, and wherein the back plate and the diaphragm are positioned such that the acoustic waves are incident on the back plate and the diaphragm.

8. The MEMS microphone of claim 7, wherein the MEMS microphone is configured to withstand a bias voltage between the diaphragm and the back plate of greater than or equal to 30 volts.

9. The MEMS microphone of claim 7, wherein the package further comprises:

an application specific integrated circuit (ASIC) electrically coupled to the MEMS acoustic sensor, wherein the ASIC is configured to process a datum generated by the MEMS acoustic sensor.

10. A micro electro-mechanical system (MEMS) microphone having a sensitivity factor limited to between a range from −38 decibel (dB) volts per pascal to −42 dB volts per pascal, wherein the MEMS microphone comprises:

a package substrate having a port disposed through the package substrate, wherein the port is configured to receive acoustic waves; and a lid mounted to the package substrate and forming a package, wherein the MEMS microphone is comprised of a package having a port for receiving acoustic waves and comprising:

a MEMS acoustic sensor comprising a diaphragm and a back plate substantially parallel to the diaphragm and positioned such that the acoustic waves are incident on the back plate and the diaphragm, wherein the MEMS microphone is configured to withstand a bias voltage between the diaphragm and the back plate of greater than or equal to 25 volts.

11. The MEMS microphone of claim 10, wherein the MEMS microphone further comprises:

a MEMS acoustic sensor disposed in the package and coupled to the package substrate, wherein the MEMS acoustic sensor is positioned such that the acoustic waves receivable at the port are incident on the MEMS acoustic sensor.

12. The MEMS microphone of claim 11, wherein the MEMS acoustic sensor comprises:

a diaphragm positioned at a first location; and a back plate positioned at a second location.

13. The MEMS microphone of claim 12, wherein a distance between the first location and the second location forms a defined sense gap that is greater than or equal to three microns, and wherein the MEMS microphone further comprises:

an application specific integrated circuit (ASIC) disposed within the package and configured to process information generated by the MEMS acoustic sensor.

14. A micro electro-mechanical system (MEMS) microphone having a resonant frequency less than 40 kilohertz and having a sensitivity factor less than −42 dB volts per pascal, wherein the MEMS microphone is comprised of a package having a port for receiving acoustic waves, and wherein the MEMS microphone is configured to withstand a bias voltage between a diaphragm and a back plate of greater than 25 volts.

15. The MEMS microphone of claim 14, wherein the MEMS microphone comprises:

a MEMS acoustic sensor comprising a diaphragm and a back plate substantially parallel to the diaphragm and positioned such that the acoustic waves are incident on the back plate and the diaphragm.

16. The MEMS microphone of claim 15, wherein the package further comprises:

an application specific integrated circuit (ASIC) electrically coupled to the MEMS acoustic sensor.

17. The MEMS microphone of claim 16, wherein the ASIC is configured to process a datum generated by the MEMS acoustic sensor.

18. The MEMS microphone of claim 14, wherein the MEMS microphone is configured to withstand a bias voltage between a diaphragm and a back plate of the MEMS microphone and the bias voltage is greater than 30 volts.

* * * * *